United States Patent [19]

Weetman et al.

[11] Patent Number: 4,896,971

[45] Date of Patent: Jan. 30, 1990

[54] MIXING APPARATUS

[75] Inventors: Ronald J. Weetman; Richard A. Howk, both of Rochester, N.Y.

[73] Assignee: General Signal Corporation, Stamford, Conn.

[21] Appl. No.: 31,307

[22] Filed: Mar. 26, 1987

[51] Int. Cl.[4] ..... B01F 7/18

[52] U.S. Cl. ..... 366/330; 366/331; 416/223 R; 416/244 R; 261/77; 261/84

[58] Field of Search ..... 366/279, 292, 293, 295, 366/325–331, 342, 343, 102–104; 416/223 R, 231 A, 241 A, 243, 243 A, 244 R; 261/75, 76, 77, 84

[56] References Cited

U.S. PATENT DOCUMENTS

| | | | |
|---|---|---|---|
| 850,525 | 4/1907 | Dazey | 366/330 |
| 1,706,608 | 3/1929 | Holmes | 416/243 |
| 2,460,902 | 2/1949 | Odor | 416/223 |
| 2,703,625 | 3/1955 | Hathaway et al. | 416/243 A |
| 2,985,245 | 5/1961 | Maloof | 416/223 R |
| 3,154,601 | 10/1964 | Kalinske et al. | 366/102 |
| 3,279,684 | 10/1966 | Waters | 416/223 |
| 3,887,300 | 6/1975 | Quinn | 416/223 |
| 3,969,446 | 7/1976 | Franklin, Jr. . | |
| 4,364,667 | 12/1982 | Reiner . | |
| 4,468,130 | 8/1984 | Weetman | 366/330 |
| 4,548,765 | 10/1985 | Hultholm et al. | 366/327 |
| 4,671,739 | 6/1987 | Read et al. | 416/241 A |

FOREIGN PATENT DOCUMENTS

| | | | |
|---|---|---|---|
| 10813 | 9/1933 | Australia | 416/223 |
| 2505523 | 8/1976 | Fed. Rep. of Germany . | |
| 1089872 | 10/1954 | France | 416/243 |
| 46659 | 11/1984 | Japan | 366/343 |
| 1194385 | 11/1985 | U.S.S.R. | 366/343 |
| 25771 | 11/1903 | United Kingdom | 416/243 |

OTHER PUBLICATIONS

Kurt Lange, Ed. "Handbook of Metal Forming" (1985), p. 2.18 and Chapter 19.

Phila. Mixers, Advertising Bulletin PFM-84, "Fluid Mixing Optimizing the System & Scaling it up".

American Prochem Eqmt. Inc, Advertising Brochure P-400, "Prochem Engineers of High Efficiency Maxflo Agitators & Mixers for the Process Industries".

American Prochem Eqmt., Inc—advertisement "Prochem Gives You a Choice in Gas Dispersion".

American Prochem Eqmt., Inc—Advertisement "Prochem Gives You a Choice in Mixing".

*Primary Examiner*—Harvey C. Hornsby
*Assistant Examiner*—Joseph S. Machuga
*Attorney, Agent, or Firm*—Martin LuKacher

[57] ABSTRACT

A mixer which provides axial flow in a non-uniform flow field, such as may be established by gas which is sparged into a medium being mixed in a tank, and provides large axial flow volume without flooding and withstands variable loads on the blades thereof, thereby providing for reliable operation. The mixer impeller is made up of paddle shaped blades, which near their tips (e.g., at 90% of the radius of the impeller from its axis of rotation) are of a width at least 40% of the impeller'a diameter. The blades also having camber, twist and flat sections. The flat sections being at least in the center area of the base of the blades. The hub for attaching the blades to the shaft of the mixer has radially extending arms with flat surfaces. The base of the blades are spaced from the shaft to define areas therebetween. These areas are reduced in size, thereby limiting the passage of sparging gas between the blades and the shaft and the strength of the coupling between the blades and the shaft are enhanced by backing plates of width greater than the width of the arms. These backing plates are fastened between the arms and the flat sections of the blades. Bolts extending through aligned holes in the arms, backing plates and blades provide strong and secure attachment of the impeller blades to the shaft so that the impeller will operate reliably in the environment which provides variable loads on the blade.

21 Claims, 7 Drawing Sheets

MIXING APPARATUS

DESCRIPTION

The present invention relates to mixing apparatus having impeller means for circulating liquids and liquid suspensions in a tank or other region, which impeller means includes a plurality of blades, and to methods of fabricating such blades.

The invention is especially suitable for use in applications where gas, such as air or oxygen, is sparged and mixed with and dissolved into the liquid or liquid suspension being circulated in the tanks. The mixing apparatus provided in accordance with the invention is also adapted for use wherever large axial flow of a liquid or liquid suspension is desired. The method of fabricating an impeller blade in accordance with the invention may be used to make blades for various mixing impellers out of metal plates.

Radial flow impellers with blades in the form of paddles perpendicular to the direction of rotation and pitched blade turbines with paddles inclined at 45° to the angle of rotation have been used to circulate liquids and liquid suspensions. Such large flow volumes are believed to facilitate the sparging or mixing and dissolving of gases such as air and oxygen into the medium being mixed. While axial flow impellers have been used in sparging applications, their use has been limited to applications where large gas volumes are relatively easy to disperse, as in waste water treatment.

In addition providing large flow volume so as to maximize gas handling while still providing a predominantly axial flow, a critical problem of reliability of the mixing impeller has presented itself. The environment about the impeller is one which gives rise to large variable loads on the impeller blades. The variable loads are believed to be due to the non-uniform flow field presented by the circulating medium and the gas bubbles therein which tend to travel in a direction opposite to the direction of pumping. Pumping by the impeller is normally in a downward direction so that axial flow downwardly and then upwardly along the sides of the tank occurs. Such flow must be maintained in large volume in order to prevent flooding. Flooding is a condition where the gas is not driven with the circulating fluid, but rather moves against the fluid flow. On flooding, a turbulent boiling condition appears at the surface of the tank. In the presence of such non-uniform flow fields the blades can fail at their attachment to the shaft, which is usually at the hub which connects the impeller blades to the shaft. Merely applying more turning power to the shaft does not solve the blade failure problem, since the loads on the blades at their attachment are only increased. Moreover, operating the mixer at increased power is undesirable in that the cost of energy is a principal factor in the cost of the process.

Accordingly, it is the principal object of the present invention to provide improved mixing apparatus by which large volumes of axial flow can be obtained without flooding where gas is being handled and which is reliable in operation, notwithstanding the non-uniform flow field which can place large variable loads on the blades of the mixing apparatus impeller.

It is a further object of the present invention to provide improved mixing apparatus which is operative reliability in an environment which provides variable loads on the impeller blades.

It is a still further object of the present invention to provide improved mixing apparatus by means of which large axial flow volumes of the medium which is being circulated can be obtained.

It is a still further object of the present invention to provide improved mixing apparatus having an impeller which circulates liquid and liquid suspensions with predominantly axial flow, and at high flow rates, with efficient utilization of energy.

It is a still further object of the present invention to provide an improved axial flow impeller, the installation of which is facilitated because the blades are of a shape such that they can be brought through access openings (manways) in tanks in which the mixer is used.

Briefly described, an improved mixer in accordance with the invention has a shaft with means for its rotation. A hub on the shaft has an arm extending radially from the shaft. An impeller which provides flow, which is predominantly in the direction axially of the shaft in non-uniform flow fields such as a flow field which tends to be influenced by the flow of a gas, has blade means including a blade of paddle shape, such as rectangular planform, with a tip end, a base end and leading and trailing edges. More generally the blade has a shape where near its tip (e.g., 90% of the radius from the shaft axis), the width is at least 40% of the diameter of the circle of rotation of the tip. The blade has camber along the chord between its leading and trailing edges and also has a flat section along a surface extending along a region, preferably as defined by a diagonal between the tip and base ends between a point on the tip end closer to the trailing edge than the midpoint of the tip between the leading and trailing edges thereof and a point on the base closer to the leading edge than the midpoint between the leading and trailing edges. This flat section is attached to the hub arm, preferably with a backing plate between the arm and the flat section. The backing plate is greater in width than the arm. It distributes the forces holding the blade and the arm in engagement with each other. The base of the blade may be spaced from the shaft, leaving an area therebetween which can provide a passage for gas. The backing plate reduces this passage, thereby enhancing the gas handling capacity of the mixer. The flat surface of the blade at the arm may be set to provide a pitch angle, and the camber of the blade may be variable to provide twist. The blade, therefore, has an airfoil shape for efficient axial pumping and circulation of the medium.

The foregoing and other objects, features and advantagaes of the invention as well as the preferred embodiment and best mode of practicing the invention will become more apparent from a reading of the following description in connection with the accompanying drawing in which.

Figure 1:
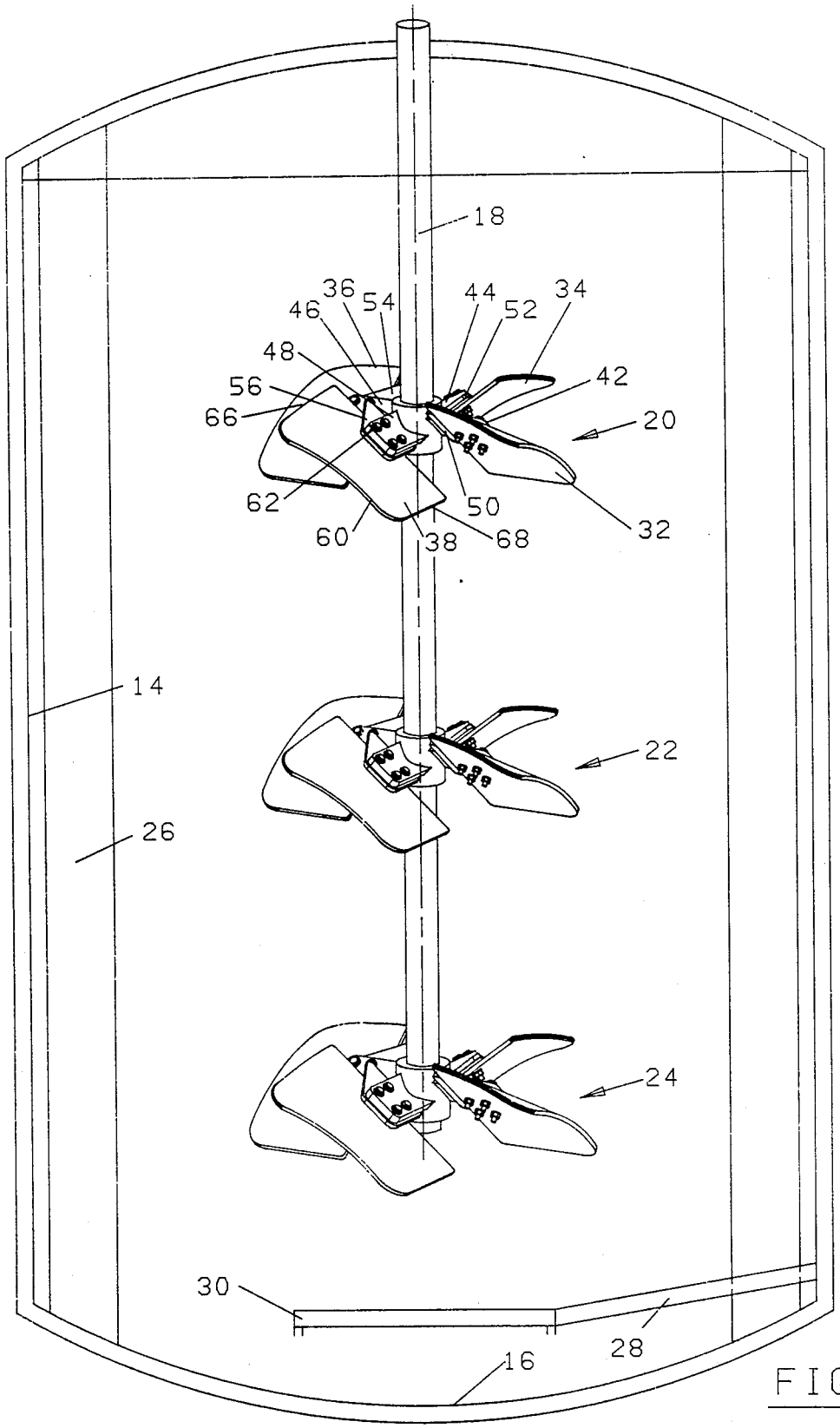
FIG. 1 is a perspective view looking downwardly at a slight angle into a tank and showing a mixer having a plurality of impellers on shaft disposed in the tank.
Figure 2:
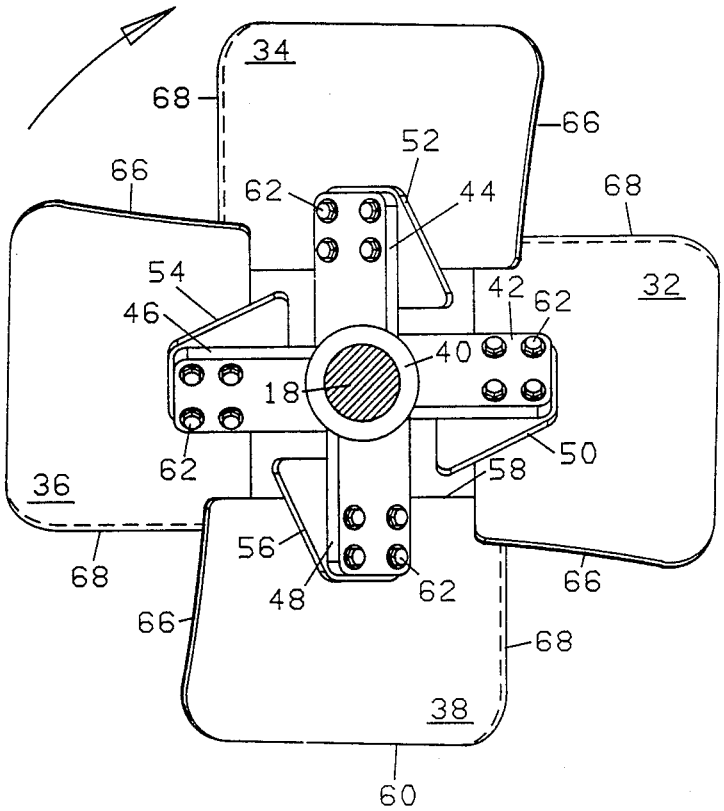
FIG. 2 is a view from the top of one of the impellers shown in FIG. 1.
Figure 3:
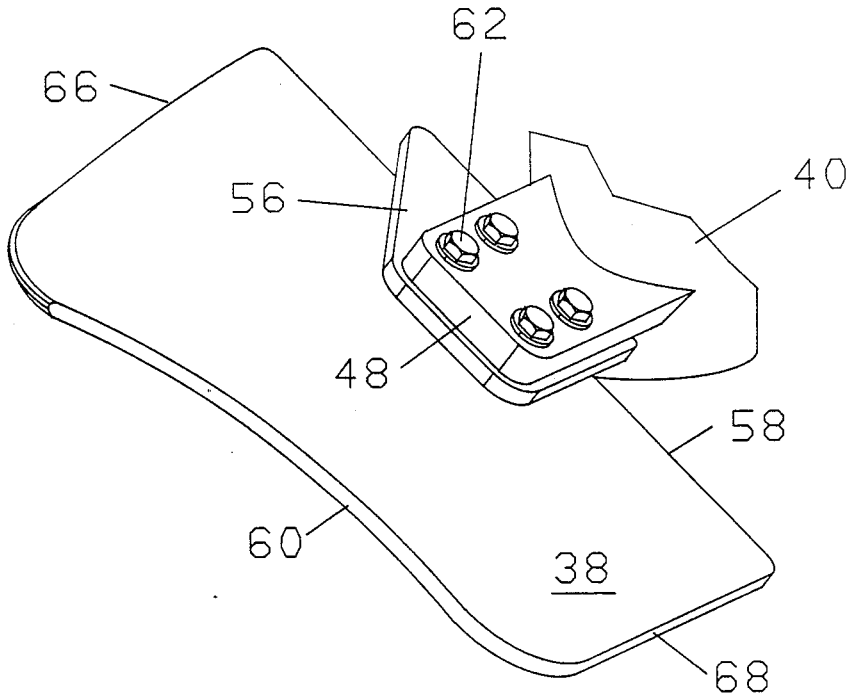
FIG. 3 is an enlarged view from the top in perspective showing one of the impeller blades, its hub, connecting arm and its backing plate.

Referring first to FIG. 1 there is shown the mixer 10 extending downwardly into a tank 12, the circular inside wall 14 and the base 16 of which appear from the top. This tank may be closed on the top. The shaft 18 extends axially of the tank along its center to a gear box and drive motor which with the shaft provides means for its rotation and the rotation of the impeller system of the mixer.

The impeller system in the mixer illustrated in FIG. 1 contains three four-bladed impellers 20, 22 and 24. The impeller 24 at the bottom may be of larger diameter than the other two impellers. It also may be a conventional shear type or radial flow impeller such as the R100 impeller (Ruston type) which is available from the Mixing Equipment Company, a Unit of General Signal Corporation, 135 Mt. Read Boulevard, Rochester, N. Y. 14603.

The tank may have, extending radially from its inside wall 14, a plurality of baffles or fins 26. The mixing system is also designed to sparge gas, such as air oxygen which enters via piping 28 to a sparge ring 30 of rectangular form, which is disposed at or near the bottom 16 of the tank and below the lower most impeller 24. An open pipe, which like the ring provides a stream of gas bubbles, may alternatively be used. It is these gas bubbles, which create the non-uniform flow field in the tank. Such a flow field interferes with the axial flow produced by the impellers 20 to 24 and gives rise to variable stresses therein particularly where they are attached to the shaft.

The impellers each have four blades which are generally rectangular plates. The four blades of the uppermost impeller 20 are indicated at 32, 34, 36 and 38. Each of these blades is identical and is attached to a hub 40 which is keyed and attached to the shaft. The hub may be a split hub which is bolted to the shaft. Extending from the hub are four arm members, equally spaced 90° apart. These arm members are bars 42, 44, 46 and 48 which are flat on their undersurface where they are connected to the plates via backing plates 50, 52, 54 and 56.

The blades have base edges, such as shown at 58 for the blade 38, which are spaced from the hub so that the blades may have no greater than a certain width between their tips 60 and their bases 58. The principal pumping action occurs at the tip 60. The tip is desirably made wide and at least 40% of the diameter in width at a distance of 90% of the radius from the axis of the shaft 18. Other paddle shapes than rectangular having such a tip configuration are useable. However the rectangular shape is preferred.

The use of paddle blades, such as are substantially rectangular, and have a limited width provides an important feature of the invention. Such blades are normally retrofitted onto existing mixer installations. The principal access to the mixer is through a manway or manhole in the tank, which is otherwise enclosed. By providing impeller blades of the shape described in this application, such blades can readily be brought into the tank and installed on the shaft.

The backing plates 50 to 56 are generally trapezoidal and have leading edges which are inclinded to the base 58. The backing plates reduce the space between the base 58 and the shaft and reduce the flow of gas through this space, thereby enhancing gas handling and promote the axial flow of the gas with the liquid through the tank. In the illustrated mixer the impellers are down pumping and pump the liquid or liquid suspension axially downward. Then the liquid flows axially upward from the bottom of the tank along the sides of the tank there guided by the vanes 26, which reduce swirling at the walls of the tank 14.

Another important feature arising out of the means for attachment of the blades is that the blades are formed so that they have a flat region or section at the area of attachment to the hub arms 42 to 48. The backing plates 50 to 56 are also flat. The backing plates also spread the load which is applied by the fluid environment on the blades and reduce stress concentrations on the blades. The flat sections of the blades, the backing plates and the arms have aligned holes (fourholes being used) through which bolts 62 extend. These bolts are fastened by nuts on the under or pressure sides of the blades. Because the surfaces to which the bolts are connected and through which the bolts extend are flat, cocking of the bolts or nuts is prevented. The preload on the bolts, which is obtained when the bolts are initially tightened in place, is maintained. Such a preload provides the strength in principal part to a bolted connection. Bolted connections are stronger and more reliable than welded connections in a dynamic environment.

In the dynamic environment in which the impellers are disposed they can be subject to large dynamic loads. Such loads are only exacerbated by the non-uniform and non-homogenous flow field when sparging gases are in the environment. Welded connections at the hub tend to fail. Bolted connections to a non-flat surface make contact at either the head or nut of the bolt, or both, at a limited area. These minimal areas of contact tend to work loose thereby losing the preload on the bolted connection and its principal strength. The blades then can vibrate and can either work loose the bolts or provide a flexural failure. The attachment means, provided by the invention, utilizing a flat area on the blade, and a flat arm on the hub provides a strong connection which is not subject to failure. This connection is enhanced and the further benefits of controlling the flow of the gas are obtained using the backing plates 50 to 56.

Figure 5:
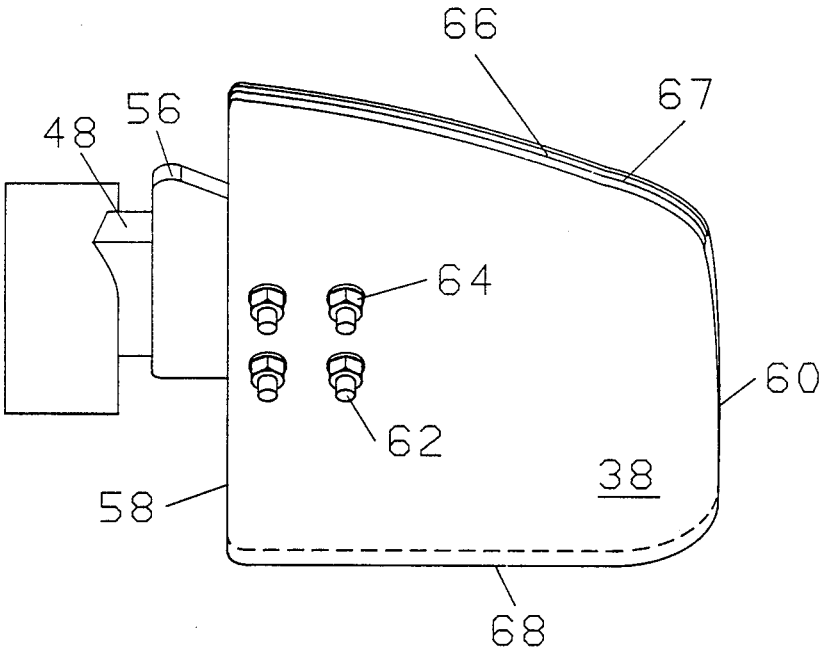
FIG. 5 is a side view of the impeller, looking toward the leading edge of one of the four blades.

High efficiency pumping so as to provide large flow volumes, as well as the shape of the blade to provide the flat section for the strong connection to the shaft are also provided by the blades. The mounting means, namely the hub, bolted arm and backing plates are also shown in FIGS. 2, 3, 5 and 7. The nuts 64 on the bolts are best seen in FIG. 5 which views the blade 38 from the front looking into its leading edge 66. The camber of the blade and its pitch or hub chord angle (HCA) will also be apparent from the location of the trailing edge 68 below and behind the leading edge 66. It will also be observed that the blades overlap each other, the leading edges of the blades overlying the trailing edges of their preceding blades.

Figure 4:
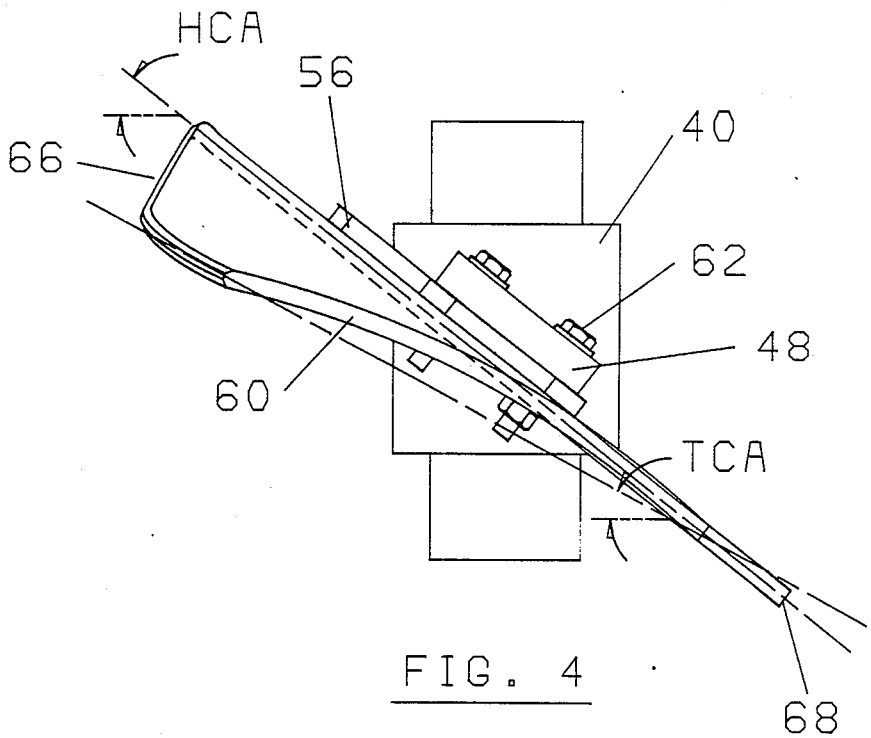
FIG. 4 is an end view of a blade looking toward the tip of the blade.

Referring to FIGS. 2, 3, 4, 5 and 7 it will be seen that each impeller blade, of which the blade 38 which is shown enlarged in the figures is typical, is a plate having a compound curvature to define an airfoil having camber between its leading and trailing edges as well as twist. The pitch of the blade is set by the inclination of the hub arms 42 to 48 with respect to a plane perpendicular to the axis of the shaft 18. Due to the twist in the blade the pitch can very from the angle at the tip or tip chord angle (TCA) to the angle nearest the hub or hub chord angle (HCA) as shown in FIG. 4. Typical and preferable values of TCA are 28% and of HCA are 38° (approximately). The TCA may vary from approximately 18° and 34°. The twist (the difference between the HCA and TCA) may vary between 8° to 12° (approximately). The pitch angle, at approximately 0.7 or seventy percent of the radius from the shaft axis, may suitably be approximately 34°.

Figure 7:
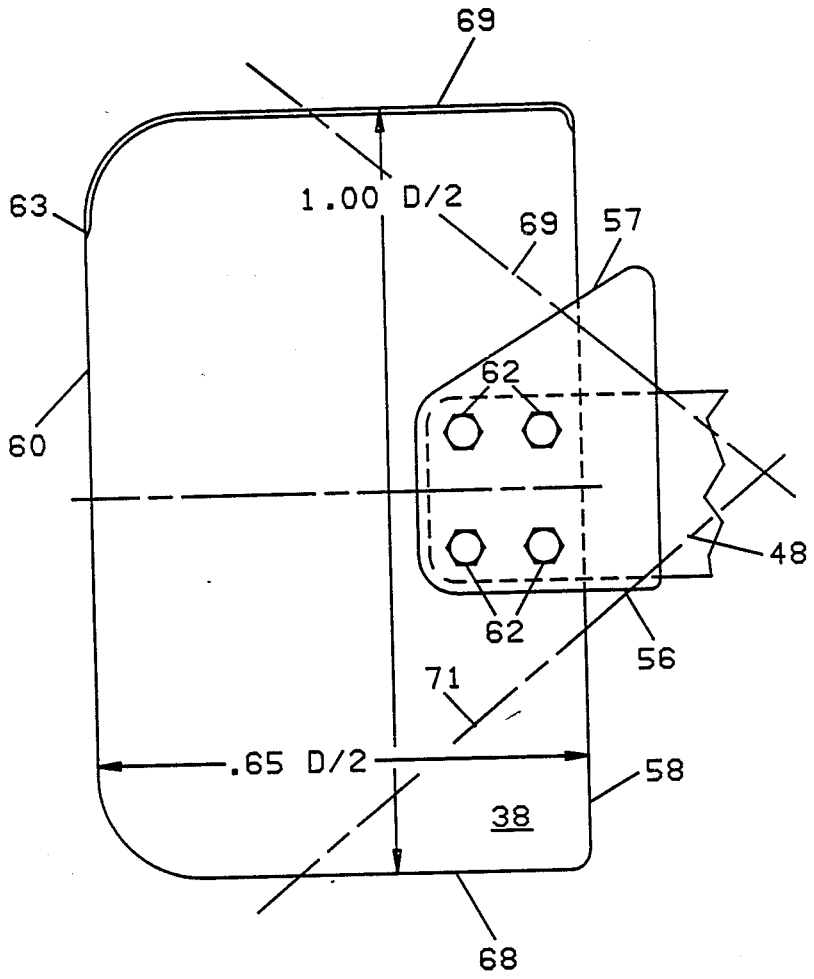
FIG. 7 is a planform of an impeller blade and its backing plate.

As pointed out above, the blade curvature is complex and leaves a flat region along the bisector of the blade (the blade center line) which is close to the hub center line as shown in FIG. 7. In this embodiment of the invention the flat region extends from the base 58 of the blade towards the front to at least 50% of the radius (0.5 D/2) as shown in FIG. 7 and thence towards the trailing edge 68. This flat region will also be apparent from the end view shown in FIG. 5. The blade is curved along an arc towards its leading edge 66 to provide the requisite camber (the distance between the chord and the midline through the thickness ofthe blade). The camber as a percent of the chord may vary from approximately 4% to 8% at the tip to 0% to 4% at the base. Nominally the camber may vary from 6% at the tip to 0% at the base.

The corners of the blade between the tip 60 and the leading and trailing edges 66 and 68 are rounded. The tip of the blade is straight in planform for approximately 70% of its length. This straight section reduces the width of the blade while keeping the large effective radius (shown at 63) of the impeller determined by the radius at the tip leading edge. As pointed out above the width is desirably limited to enable the blade to be brought through a manway for installatlion on the mixer shaft with the hub and backing plates. The radius at each corner is approximately 15% of the length of the blade between its leading and trailing edges.

It will also be seen from FIG. 7 that the leading edge 66 is swept back with respect to a radial line 69 from the shaft axis. The trailing edge is also swept forward with respect to a radial line 71 from the shaft axis. The leading edge of the mounting plate 56 therefore not only does not interfere with the pumping action but also assists such action. The leading edge is desirably inclined. The leading edge has a double chamfer as shown in FIG. 5 at 67. Such a contoured leading edge facilitates efficiency (reducing leading edge separation) for axial flow pumping. The leading edge may also be radiused. It may also have a blunt leading edge if added turbulence is desirable.

Figure 6:
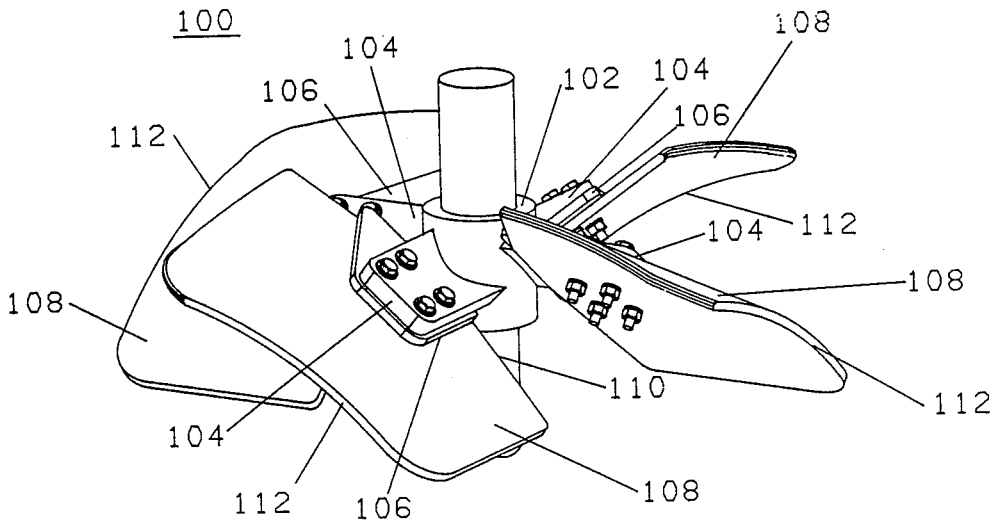
FIG. 6 is a perspective view of an impeller and its hub in accordance with another embodiment of the invention.

Referring to FIG. 6 thee is shown another embodiment of an impeller 100 in accordance with the invention. This impeller has a hub 102 of a design similar to the hub 40 with arms 104 and backing plates 106 which provide a strong connection to the blades 108. These blades may be formed to provide camber and twist and may be mounted at the requisite pitch angles in the same manner as described in connection with FIGS. 1 through 5 and 7. The base end of the blade, however, is trapezoidal in shape as shown at 110 and extends to the hub 102. The important feature of the invention of providing for high efficiency axial flow is obtained since near the tip 112 the width of the blade is maintained. Specifically near the tip or at approximately 0.9R (the radius from the center of the shaft (the shaft axis) to the tip the blade) is at least 40% of the blade diameter. Accordingly the features of the invention can be provided with other paddle like shapes such as shown in FIG. 6.

From the foregoing description it will be apparent that there has been provided improved mixer apparatus. Variations and modifications of the mixer apparatus will undoubtedly suggest themselves to those skilled in the art. For example the backing plate may be made integral with the arms of the hub instead of in two pieces as described in the foregoing embodiment. The plate may also be extended and shaped in other shapes rather than the preferred trapezoidal shape of the backing plate, as illustrated. The mixer system utilizing the blade configurations and shapes of the impeller is also useful in applications where the system is operative beyond flooding. Then, while the flow will not be predominantly axial, there will be sufficient flow in a radial direction to maintain mixing and gas dispersing action. It will also be appreciated that the mixer apparatus can be used as a side entry rather than a top entry mixer and is especially adapted for such use when there are non-uniform flow fields in the vicinity of the impeller. The mixer apparatus could also be used in mixer applications where the flow is nearly uniform but the loads on the blades are very large. Other variations and modifications of the herein described mixer, within the scope of the invention will undoubtedly suggest themselves to those skilled in the art. Accordingly the foregoing description should be taken as illustrative and not in a limiting sense.

We claim:

1. A mixer which is adopted to operate in non-uniform flow fields such as the flow field which tends to be influenced by the flow of a gas, which mixer comprises a shaft adapted to have means for its rotation, a hub on said shaft having an arm extending radially from said shaft, an impeller which provides flow which is predominantly in the direction axially of said shaft in such non-uniform flow fields, said impeller having blade means, including a blade of paddle-shaped planform with a tip end, a base end and leading and trailing edges, said blade in the vicinity of 90% of a radius from the axis of said shaft being of width at least 40% of the impeller's diameter, said blade having camber along a chord between its leading and trailing edges and having a flat section along a surface extending in a region along the diagonal between the tip and base ends, said diagonal extending between a point on the tip end closer to the trailing edge than to the midpoint of said tip between the leading and trailing edges and another point on the base end closer to the leading edge than the midpoint between said leading and trailing edges, means for attaching said arm to said flat section to mount said blade on said hub, plate means providing to said arm an extension having a width greater than the width of said arm and extending beyond said arm, and said plate means being disposed along said flat surface of said blade at said base and along at least one side of said arm.

2. The mixer according to claim 1 wherein said base end is attached to said arm spaced radially away from said shaft, said plate means extending between said base edge and said shaft and occupying at least part of the space therebetween.

3. The mixer according to claim 2 wherein said plate means is a plate which has leading and trailing edges, said leading edge being inclined such that the projections of the plate's leading edge and the blade's leading edge intersect at an obtuse angle in a direction outwardly of said blade and plate 4. The mixer according to claim 2 wherein said plate means is trapezoidal in shape and has an apex between the base and a side thereof which extends in the direction of said leading edge.

5. A mixer which is adapted to operate in non-uniform flow fields such as the flow field which tends to be influenced by the flow of a gas, which mixer comprises a shaft adapted to have means for its rotation, a hub on said shaft having an arm extending radially from said shaft, an impeller which provides flow which is predominantly in the direction axially of said shaft in such non-uniform flow fields, said impeller having blade means, including a blade of paddle-shaped planform with a tip end, a base end and lealding and trailing edges, said blade in the vicinity of 90% of a radius from the axis of said shaft being of width at least 40% of the impeller's diameter, said blade having camber along a chord between its leading and trailing edges and having a flat section along a surface extending in a region spaced away from said leading edge and along the diagonal between the tip and base ends, said diagonal extending between a point on the tip end closer to the trailing edge than to the midpoint of said tip between the leading and trailing edges and another point on the base end closer to the leading edge than the midpoint between said leading and trailing edges, means for attaching said arm to said flat section to mount said blade on said hub, said arm having a surface which is flat and is disposed in juxtaposition with said flat section, said arm and said flat section having a plurality of aligned holes therethrough, bolts in said holes fastening said arm and said blade tightly together, a backing plate being disposed between the flat section of said blade and arm, said backing plate extending radially outward a distance greater than said arm and being wider than said arm, said backing plate having holes therethrough aligned with said holes in said blade and said arm for receiving said bolts therethrough.

6. A mixer which is adapted to operate in non-uniform flow fields such as the flow field which tends to be influenced by the flow of a gas, which mixer comprises a shaft adapted to have means for its rotation, a hub on said shaft having an arm extending radially from said shaft, an impeller which provides flow which is predominantly in the direction axially of said shaft in such non-uniform flow fields, said impeller having blade means, including a blade of paddle-shaped planform with a tip end, a base end and leading and trailing edges, said blade in the vicinity 90% of a radius from the axis of said shaft being of width at least 40% of the impeller's diameter, said blade having camber along a chord between its leading and trailing edges and having a flat section along a surface extending in a region spaced away from said leading edge and along the diagonal between the tip and base ends, said diagonal extending between a point on the tip end closer to the trailing edge than to the midpoint of said tip between the leading and trailing edges and another point on the base end closer to the leading edge than the midpoint between said leading and trailing edges, means for attaching said arm to said flat section to mount said blade on said hub, the tip of said blade being straight in planform for approximately 70% of its length to increase the effective radius of the impeller without increading the width between the base and the tip of the blade.

7. The mixer according to claim 6 wherein said blade is curved where said leading and trailing edge intersect said tip end with a radius of about 15% of the length of said blade between its leading and trailing edges.

8. The mixing apparatus according to claim 6 wherein said leading edge of said blade is of a shape selected from the group consisting of one chamfer, mutually inclined chamfers, blunt and radiused.

9. A mixer which is adapted to operate in non-uniform flow fields such as the flow field which tends to be influenced by the flow of a gas, which mixer comprises a shaft adapted to have means for its rotation, a hub on said shaft having an arm extending radially from said shaft, an impeller which provides flow which is predominantly in the direction axially of said shaft in such non-uniform flow fields, said impeller having blade means, including a blade of paddle-shaped planform with a tip end, a base end and leading and trailing edges, said blade in the vicinity of 90% of a radius from the axis of said shaft being of width at least 40% of the impeller's diameter, said blade having camber along a chord between its leading and trailing edges and having a flat section along a surface extending in a region spaced away from said leading edge and along the diagonal between the tip and base ends, said diagonal extending between a point on the tip end closer to the trailing edge than to the midpoint of said tip between the lealding and trailing edges and another point on the base end closer to the leading edge than the midpoint between said leading and trailing edges, means for attaching said arm to said flat section to mount said blade on said hub, a plurality of said blades being provided, each attached at the flat surface thereof to a different one of a plurality of said arms, and said blades overlapping each other with the leading and trailing edges thereof overlying each other.

10. In mixing apparatus having a shaft with means for its rotation said shaft having a hub region with a plurality of arms extending radially therefrom, an improved impeller have a plurality of blades characterized in that each blade is substantially a plate of paddle like shape, including generally rectangular shape in planform, with a width at about 90% of the radius from the axis of the shaft being at least 40% of the diameter of the impeller, and having leading and trailing edges, a base and a tip, at least one side of said blades being flat in a section thereof in an area of said one side extending from the base toward the tip, said flat sections and said arms of each of said blades being disposed in juxtaposition with said base away from said shaft to define a space therebetween, a plurality of backing plates, each disposed between a different one of said blades and said arms, said backing plates extending radially beyond the end of said arms into said blades and having widths greater than the widths of said arms to partially fill the space between said base and said shaft, whereby to reduce the flow of any gas which is adapted to be sparged below said impeller.

11. The apparatus according to claim 10 wherein said backing plate is trapezoidal in shape and has a base adjacent to said shaft and a top which extends into said blase, said backing plate having a leading edge closer to said leading edge of said blade than to the trailing edge thereof, said leading edge of said backing plate being inclined at an acute angle to the base of said backing plate.

12. The mixing apparatus according to claim 10 wherein said flat section extends along a midline of said blade between midpoints of the base and tip thereof.

13. A mixer which is adapted to operate in non-uniform flow fields such as the flow field which tends to be influenced by the flow of a gas, which mixer comprises a shaft adapted to have means for its rotation, a hub on said shaft having an arm extending radially from said shaft, an impeller which provides flow which is predominantly in the direction axially of said shaft in such non-uniform flow fields, said impeller having blade means, including a blade of paddle-shaped planform with a tip end, a base end and leading and trailing edges, said blade in the vicinity of 90% of a radius from the axis of said shaft being of width at least 40% of the impeller's diameter, said blade having camber along a chord between its leading and trailing edges and having a flat section along a surface extending in a region spaced away from said leading edge and along the diagonal between the tip and base ends, said diagonal extending between a point on the tip end closer to the trailing edge than to the midpoint of said tip between the leading and trailing edges and another point on the base end closer to the leading edge than the midpoint between said leading and trailing edges, means for attaching said arm to said flat section to mount said blade on said hub; and said blade being generally rectangular with its base and tip ends longer than its leading and trailing edges.

14. The mixer according to claim 13 wherein a plurality of said blades are provided, each attached at the flat surface thereof to a different one of a plurality of said arms.

15. The mixer according to claim 14 wherein said arms have flat surfaces to which said flat sections of said blades are attached in juxtaposition, said flat surfaces of said arms being inclined at such an angle to a lane perpendicular to the axis of said shaft to define the pitch angle of the blades.

16. The mixer according to claim 15 wherein said blades have twist with said pitch angle decreasing towards said tip, and said camber varying from about 4% to 8% at said tip to about 0% to 4% at said base.

17. The mixer according to claim 16 wherein said twist varies from between about 8° and 12°.

18. The mixer according to claim 17 wherein said pitch angle is between about 18° and 34° at said tip.

19. The mixer according to claim 15 wherein a plurality of said impellers are provided spaced axially from each other along said shaft.

20. The mixer according to claim 13 wherein said arm has a surface which is flat and is disposed in juxtaposition with said flat section, said arm and said flat section having a plurality of aligned holes therethrough, and bolts in said holes fastening said arm and said blades tightly together.

21. The mixer according to claim 13 wherein said leading and trailing edges are approximately parallel to each other, said leading edge is swept back with respect to a radial line extending from the axis of said shaft which intersects said leading edge and said trailing edge is swept forward with respect to a radial line extending from the axis of said shaft which intersects said trailing edge.

* * * * *